US005403469A

United States Patent [19]

Vauk et al.

[11] Patent Number: 5,403,469

[45] Date of Patent: Apr. 4, 1995

[54] PROCESS FOR PRODUCING FCC FEED AND MIDDLE DISTILLATE

[75] Inventors: Dennis A. Vauk, Santa Ana; Christopher J. Anderle, Diamond Bar, both of Calif.

[73] Assignee: Union Oil Company of California, Los Angeles, Calif.

[21] Appl. No.: 146,797

[22] Filed: Nov. 1, 1993

[51] Int. Cl.[6] ..... C10G 65/00; C10G 65/14; C10G 45/00; C10G 47/00

[52] U.S. Cl. ..... 208/78; 208/58; 208/93; 208/102; 208/103

[58] Field of Search ..... 208/58, 78, 80, 83, 208/93, 94, 100, 102, 89, 103, 104, 105, 209, 212, 213, 222, 96, 97, 68

[56] References Cited

U.S. PATENT DOCUMENTS

| | | | |
|---|---|---|---|
| 4,676,887 | 6/1987 | Fisher et al. | 208/68 |
| 4,738,766 | 4/1988 | Fisher et al. | 208/68 |
| 4,789,457 | 12/1988 | Fisher et al. | 208/68 |
| 4,828,677 | 9/1989 | Fisher et al. | 208/68 |
| 4,919,789 | 4/1990 | Fisher et al. | 208/68 |
| 4,943,366 | 7/1990 | Fisher et al. | 208/89 |
| 5,203,987 | 4/1993 | de La Fuente | 208/58 |
| 5,290,427 | 3/1994 | Fletcher et al. | 208/89 |

*Primary Examiner*—Asok Pal
*Assistant Examiner*—Bekir L. Yildirim
*Attorney, Agent, or Firm*—Gregory F. Wirzbicki; Alan H. Thompson

[57] ABSTRACT

Hydrotreated and hydrocracked liquid/vapor effluents are separated in a common separating vessel under elevated pressure. High quality middle distillates and low-sulfur/low-hydrogen-containing FCC feedstocks are produced.

49 Claims, 2 Drawing Sheets

NAPHTHA + LIGHTER
JET
DIESEL
FLUID CATALYTIC CRACKING UNIT
FRACT.
$H_2$ SOURCE
RECYCLE GAS COMPRESSOR
SEPARATOR
HC
HT
VACUUM TOWER
10
11
12
13
14
15
16
17
20
22
24
26
28
30
31
32
34
36
38
40
42
43
44
46
48
70

PROCESS FOR PRODUCING FCC FEED AND MIDDLE DISTILLATE

BACKGROUND OF THE INVENTION

The invention relates to hydroprocessing of hydrocarbon-containing oils, particularly a combination process involving hydrotreating and hydrocracking.

During catalytic hydroprocessing, particulate catalysts are utilized to promote reactions such as cracking, desulfurization and denitrogenation. This is accomplished by contacting the particulate catalysts with a feedstock, such as a gas oil, under conditions of elevated temperature and pressure and in the presence of hydrogen so that, in the case of hydrotreating, substantial concentrations of sulfur components are converted to hydrogen sulfide and nitrogen components to ammonia, and, in the case of hydrocracking, usually under more severe conditions than hydrotreating, substantial concentrations of high molecular weight hydrocarbons are reduced to lighter, lower molecular weight hydrocarbons of lower boiling point. An advantage of hydrocracking lies in the relatively high conversion (i.e., 60 percent or more) of a sulfur-containing and/or nitrogen-containing gas oil feed, boiling for example, mostly above about 700° F. (i.e., 700° F.+ feed), to a relatively sulfur- and nitrogen-free commercial product of boiling point below 700° F. (i.e., 700° F.− product), such as naphthas and middle distillates, and more particularly, gasoline, jet fuel, diesel fuel, and mixtures thereof.

Recently, attention has been directed to producing 700° F.− product at relatively low pressure conditions—a hydroprocess commonly known as "mild hydrocracking." Since the cost of constructing a hydrocracking unit operating at high pressures is quite significant and poses a major economic obstacle to its use, interest has developed in converting existing hydroprocessing units, such as hydrotreating or hydrodesulfurization units, into hydrocracking units. It is realized, of course, that hydrotreating units and the like are not normally designed for optimum hydrocracking conditions, and specifically, not for the high pressures usually employed in commercial hydrocracking, i.e., above 1,500 p.s.i.g. Nevertheless, there is still an advantage if even some hydrocracking (such as up to 35 percent) can be achieved under the low pressure constraints of typical hydrotreating or hydrodesulfurization units, and a challenge to the art is to discover mild hydrocracking processes yielding sufficient amounts and quality of the middle distillate and naphtha products to be commercially useful under such mild hydrocracking conditions. Typically, hydrocarbon products from "mild hydrocrackers" result in poor quality middle distillates, as for instance, jet fuel smoke points less than 15 mm and diesel fuel cetane indexes less than 40. Furthermore, such hydroprocesses ordinarily produce mostly feedstocks for fluid catalytic cracking (FCC) units.

In contrast to the "mild hydrocracker" units, the high conversion, high pressure hydrocracking units produce good quality middle distillates and naphthas; however, the amount of accompanying low nitrogen/sulfur-containing feedstock produced for an FCC unit by high conversion hydrocracking is decreased. The produced FCC feedstock is often the result of needless overtreating or overcracking and thus, the FCC feedstock typically contains excessive hydrogen.

FCC units are used in the petroleum industry to convert high boiling hydrocarbon feedstocks to more valuable hydrocarbon products, such as gasoline, having a lower average molecular weight and a lower average boiling point than the feedstocks from which they were derived. The conversion is normally accomplished by contacting the hydrocarbon feedstock with a moving bed of cracking catalyst particles at temperatures ranging between about 800° F. and about 1,100° F. The most typical hydrocarbon feedstocks treated in FCC units comprise a heavy gas oil usually containing about 1 to 3 weight percent of sulfur impurities (principally organosulfur compounds) or a hydrotreated heavy oil usually containing less than about 0.3 weight percent of sulfur, but on occasion such feedstocks as light gas oils or atmospheric gas oils, naphthas, reduced crudes and even whole crudes are subjected to catalytic cracking to yield low boiling, low sulfur-containing hydrocarbon products.

It is well known that FCC feedstocks which contain high levels of nitrogen have a deleterious effect on cracking catalysts. The nitrogen is typically present in the form of basic or neutral organic (organonitrogen) compounds, primarily aromatic compounds containing nitrogen heteroatoms such as pyridines, quinolines, and indoles, which are strongly sorbed on the acidic sites of the cracking catalyst. The nitrogen compounds react or otherwise interact with the acidic sites so as to decrease the activity of the catalyst. This deactivation results in decreased conversions and desired product proportions. Levels of nitrogen in the feedstock as small as 0.01 weight percent, calculated as the element, can result in some decrease in activity of the catalyst; however, significant deactivation is not normally encountered unless the concentration of nitrogen in the feedstock increases to above 0.05, and usually from about 0.08 to about 0.15 weight percent (or above).

In order to avoid substantial deactivation of cracking catalysts in FCC units by nitrogen or sulfur compounds contained in the feedstock, it has been standard practice to treat such feedstocks to reduce the concentration of nitrogen and sulfur compounds prior to subjecting the feedstocks to catalytic cracking. This practice also lowers the $SO_x$ (and $NO_x$) emissions to the atmosphere during combustion of the FCC product gasoline or during regeneration of the cracking catalyst. Of the techniques employed in the past for removing the nitrogen or sulfur compounds from the feedstocks, hydroprocessing is the one most frequently used. However, in order to remove substantial quantities of residual nitrogen and sulfur, relatively high hydrogen pressures are typically required. Installation of equipment to carry out such a high pressure process requires a substantial capital investment, and the accompanying high hydrogenation pressures result in FCC feedstocks containing excessive hydrogen. The excessive hydrogen carried into the FCC unit causes overcracking of the gasoline-related molecules, and consequently, reduced amounts of gasoline are produced as lighter products, such as LPG and lighter, are formed.

A continuing aim in the petroleum refining art is to discover processing schemes which provide improved hydrocarbon product distribution. Modest or slight variations in hydroprocessing schemes can have significantly improved effects on both the quality and relative proportion of hydrocarbon products.

The petroleum refiner must balance economic considerations, such as capital expenditures (for refining equipment) and operational utility costs (for operating reactor vessels and pressurizing systems), with the quality of the desired hydrocarbon products. Accordingly, a major challenge to the art is to develop a hydroprocessing scheme utilizing hydrocracking for producing quality middle distillates and naphthas and still producing a low sulfur/low nitrogen FCC feed containing minimal hydrogen.

SUMMARY OF THE INVENTION

The invention relates to an integrated hydroprocess having separate trains of hydrocracking and hydrotreating reactors whose liquid/vapor effluents are concurrently separated in a common separator vessel under elevated common pressure (normally the pressure at the exit of the reactors). An elevated hydrogen partial pressure for the system is maintained throughout the hydroprocessing run by a common hydrogen-containing vapor separated from the effluents in the common separator and portions recycled to each of the hydrotreating and hydrocracking reactors. The liquid from the parallel train system is fractionated into high quality middle distillate products (i.e., jet fuels having smoke points above 25 and diesel fuels having cetane indexes above 45) and a feed for a fluid catalytic cracking (FCC) operation containing relatively low hydrogen concentrations (i.e., in some instances less than 13 weight percent).

In one embodiment, a vacuum gas oil (i.e., VGO) is fractionated into a relatively heavy gas oil (e.g., boiling range above 750° F.) and a relatively light gas oil (e.g., boiling range below 950° F.), the heavy gas oil is hydrotreated and the light gas oil is hydrocracked, the hydrotreated and hydrocracked effluents are concurrently passed to a common high pressure separator to separate a hydrogen-containing vapor for recycle and a liquid which is fractionated into middle distillate and lighter products and an FCC feedstock. Alternatively, the VGO is simply split into two portions and concurrently fed to the hydrotreating and hydrocracking reactors.

In another embodiment, an atmospheric residuum is initially hydrotreated, the exiting liquid effluent from the hydrotreater is then fractionated into a light fraction and a heavy fraction, at least a portion of the light fraction is hydrocracked to produce middle distillate products and the heavy fraction passed to an FCC processing unit. A hydrogen-containing vapor obtained from both the hydrotreated and hydrocracked effluents is recycled from a common high pressure separator to the hydrotreating and hydrocracking reactors.

Since the hydrogen-containing vapor effluent separated from the hydrotreated and hydrocracked effluents is maintained at relatively high hydrogen partial pressures in the recycle loop, the process of the invention maintains a single unit configuration that minimizes utility and capital costs while concurrently providing both high quality middle distillate products and an FCC feed which has not been too severely hydrotreated or hydrocracked and accordingly contains minimal hydrogen.

DETAILED DESCRIPTION OF THE INVENTION

Figure 1:
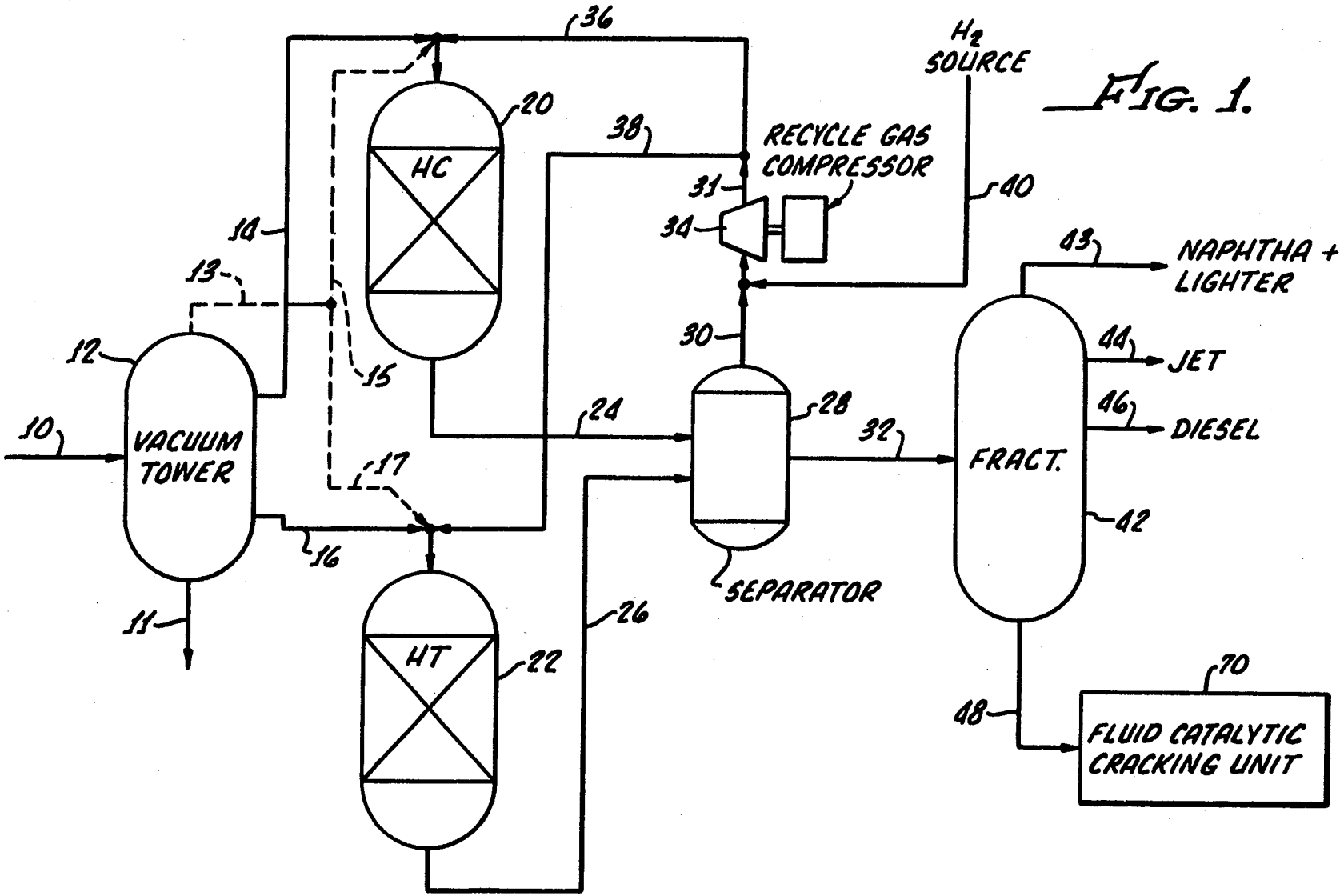

The hydroprocess of the invention is directed to parallel treatment of a feedstock by hydrotreating and hydrocracking in order to concurrently convert, in the same refining unit, relatively heavy feedstocks into an improved combination of hydrocarbon products—namely high quality middle distillates (and lower boiling products) as well as an FCC feedstock having minimal hydrogen (i.e., less than about 13.5 weight percent, calculated as H) and relatively low sulfur concentrations (i.e., typically less than 0.3 weight percent organosulfur, calculated as S). The desired product distribution is accomplished by concurrently introducing the combined vapor/liquid effluents from separate reactors (which are concurrently hydrotreating and hydrocracking separate feedstreams) into the same separator vessel(s) and common fractionator. The lighter product fractions are removed as middle distillates (and lighter) while the heavier product fractions are recovered for FCC processing and/or recycled to the hydrocracker. An advantage of the process of the invention is that the pressures in the hydrotreater, hydrocracker and at least one separator vessel can be maintained essentially the same, i.e., the system can be operated as a single integrated refining unit where the petroleum refiner can obtain both quality FCC feedstock and middle distillates.

The hydrocracking process involves contacting a hydrocracking catalyst in a catalytic hydrocracking zone with a hydrocarbon-containing feedstock (i.e., hydrocracker feed) under conditions effecting a higher percentage of liquid products boiling at or below 700° F. in the effluent as compared to the feedstock. The hydrotreating process involves contacting a hydrotreating catalyst in a catalytic hydrotreating zone with a hydrocarbon-containing feedstock (i.e., hydrotreating feed) under conditions producing (1) a lower organosulfur and organonitrogen content in the effluent and (2) at least some hydrocracking, i.e., a higher percentage of liquid products boiling at or below 700° F. in the effluent as compared to the feedstock.

The hydrocracking catalyst used herein, particularly a crystalline molecular sieve catalyst, typically deactivates in the presence of significant organonitrogen concentrations in the hydrocracker feeds. Accordingly, the hydrocracker feed entering the catalytic hydrocracking zone may first be serially hydrotreated in a suitable upstream catalytic hydrotreating zone in an integrated manner (e.g., the hydrogen partial pressure is essentially constant between the hydrotreating and subsequent hydrocracking zone) to reduce the nitrogen concentration to a level which produces minimal deactivation of the hydrocracking catalyst. The organonitrogen concentration of the hydrocracker feed is usually less than 500 ppmw, but preferably less than 200 ppmw, and most preferably less than 100 ppmw, calculated as N, for effective hydrocracking results. Thus, as referred to herein, the "catalytic hydrocracking zone" can include an upstream integrated catalytic hydrotreating zone operating in a serial manner with the downstream catalytic hydrocracking zone to lower the organonitrogen content of the hydrocracker feed into the downstream hydrocracking zone. Alternatively, the catalytic hydrocracking zone may contain a dual-function hydrotreating/hydrocracking catalyst, typically containing an amorphous support.

Hydrocarbon-containing feedstocks contemplated for treatment by the process of the invention are hydrocarbon-containing liquids and gases, including broadly all liquid and liquid/vapor hydrocarbon mixtures including petroleum oils and synthetic crudes. "Hydrocarbon" refers herein to any compound which consists of hydrogen and carbon, and "hydrocarbon-containing feedstock" refers to any charge stock which contains greater than about 90 weight percent carbon and hydrogen, calculated as the elements. Among the typical feedstocks contemplated are top crudes, vacuum and atmospheric residual fractions, light and heavy atmospheric and vacuum distillate oils, hydrocarbon distillate fractions, shale oils, and oils from bituminous sands and coal compositions and the like. Hydrocarbon compounds converted by the process of the invention include all forms, such as aliphatic, cycloaliphatic, olefinic, acetylenic, aromatic-including alkaryl and arylalkyl aromatic compounds and derivatives thereof—in addition to organometallic, organonitrogen, and organosulfur compounds, particularly those found in conventional hydrocarbon-containing feedstocks. For use herein, typical hydrocarbon oils, or mixtures thereof, may contain at least about 10 volume percent of components normally boiling above about 1,000° F. and in some cases, at least 20 volume percent.

Generally, a substantial proportion (i.e., at least about 90 volume percent) of hydrocarbon-containing feeds, such as gas oils and the like, boil at a temperature less than about 1,100° F., preferably less than about 1,050° F., and usually boil entirely within the range of about 600° F. to about 1,100° F., and most frequently in the range from about 650° F., to about 1,050° F.

Although virtually any high boiling hydrocarbon feedstock may be treated by hydroprocessing with the catalyst of the invention, the process is particularly suited to treating (1) gas oils, such as straight-run and cracked stocks from coker, visbreaker and FCC units, but preferably light and heavy vacuum gas oils, and (2) heavy residual fractions, especially atmospheric and vacuum residuum oils. Sulfur is usually present in the feedstocks, typically as organosulfur, in a proportion exceeding 0.1 weight percent, often exceeding 1.0 weight percent, and normally in the range from about 0.1 to about 8 weight percent. The feedstock contains undesirable proportions of nitrogen, typically as organonitrogen usually in a concentration greater than about 2 ppmw and often between about 2 ppmw and 5,000 ppmw. Ordinarily the feedstock contains less than 300 ppmw of nickel and vanadium contaminant metals, calculated as Ni plus V, with preferred feedstocks containing less than 20 ppmw and most preferably less than 5 ppmw of said materials. The feedstock may contain waxy components, e.g., n-paraffins and slightly-branched paraffins, and thus have a high pour point, e.g., at least about 30° F.

The initially processed hydrocarbon-containing feedstocks of the invention can be either split into at least two feed streams or fractionated (typically in a vacuum tower) into at least one relatively high boiling fraction and at least one relatively low boiling fraction prior to parallel passage to the hydrotreating and hydrocracking reaction zones (shown in FIG. 1). The relatively high boiling fraction is passed to the hydrotreating reactor, and the relatively low boiling fraction is fed to the hydrocracking reactor. The relatively low boiling fraction passed to the hydrocracking zone typically contains at least 90 volume percent of the components boiling below about 950° F., preferably below 850° F. and ordinarily in the range from about 650° F. to about 950° F. The relatively high boiling fraction passed to the hydrotreating zone typically contains at least 90 volume percent of its components boiling above 750° F., preferably above 850° F., and ordinarily in the range from about 750° F. to about 1,050° F.

In another embodiment, the feedstock, typically a VGO, is split into at least two feedstocks and fed to the separate hydroprocessing reactors (also shown in FIG. 1). In still another embodiment wherein the feedstock is typically an atmospheric residuum, the feedstock is initially hydrotreated and a relatively low boiling fraction of the separated liquid effluent passed to a hydrocracking zone (shown in FIG. 2).

An unusual feature of the invention is that liquid/vapor effluents from concurrent hydrotreating and hydrocracking in separate reactors are concurrently separated under elevated pressure, i.e., above 400 p.s.i.g., in the same separator vessel (or same combination of separator vessels). Normally the liquid and vapor effluents are introduced into the common separator and separated at an elevated hydrogen partial pressure which is essentially the same as the hydrogen partial pressure at the outlet of the hydrotreating and hydrocracking reactors. The liquid effluent from such a common separator is immediately passed to a common fractionator and fractionated into desired boiling range fractions, including 700° F.— products such as naphthas, liquid petroleum gas (LPG), light gasoline, heavy gasoline, jet fuel, diesel fuel, and the like, as well as heavier fractions such as light and heavy vacuum gas oils. Typically a light vacuum gas oil contains at least 90 volume percent of its components boiling below 950° F., and preferably below 850° F., while a heavy vacuum gas oil contains at least 90 volume percent of its components boiling above 750° F., and preferably above 850° F. The heavier gas oils are typically passed to the FCC unit for production of gasoline, whereas the lighter gas oils are recycled to the hydrocracking zone.

The heavy hydrocarbon fraction passed to an FCC unit typically contains less than 13.5 weight percent, and preferably less than 13 weight percent of hydrogen. Such a small hydrogen concentration is unusually low for an FCC feedstock obtained from an upstream hydrocracking process, especially a high conversion, high pressure hydrocracking process. The relatively small concentration of hydrogen in an FCC feedstock allows considerably less overcracking of the gasoline product obtained from the FCC unit. Furthermore, the low hydrogen content in combination with a relatively low concentration of organosulfur, typically less than 0.3 weight percent, and in some instances, less than 0.01 weight percent, provides an FCC unit with a feedstock which, when converted to gasoline, produces a low sulfur-containing combustible product having reduced $SO_x$ emission to the atmosphere and reduced FCC regenerator $SO_x$ emissions. Moreover, the nitrogen content of the heavy hydrocarbon fractions is typically about 0.05 to about 0.2 weight percent (as N), and preferably about 0.08 to about 0.15 weight percent. Such nitrogen content allows the petroleum refiner to operate the FCC unit at higher conversion. The combination of the above-described hydrogen, sulfur and nitrogen concentrations enables the petroleum refiner to operate the FCC unit without obtaining excessive overcracking of the gasoline product.

Measures of the quality of the middle distillate product fractions include cetane index and smoke point. Typically the diesel fuel fraction obtained by the process of the invention has a cetane index above 40, preferably at least 45, and highly preferred in the range from 45 to about 80. The smoke point of the jet fuel fraction is at least 20, and preferably at least 25 mm. Furthermore, the aromatic content of the middle distillate product fraction is usually less than 20, and preferably less than 10 volume percent.

The vapor effluent from the common separator usually contains hydrogen gas and relatively low boiling hydrocarbons. Generally after the liquid/vapor effluents from the hydrotreating and hydrocracking reaction zones have been passed through a heat exchanger and the common separator, the hydrogen-containing vapor is commonly and concurrently recycled to the two reaction zones. In such a hydrogen-containing vapor recycle loop, the vapor effluents may exit a single separator vessel under elevated pressure, be compressed before or after acquiring additional fresh hydrogen (as needed), and be recycled proportionately or disproportionately to the respective hydrotreating and hydrocracking reactors. Often the relatively hot vapor effluent (i.e., at least 300° F.) may be combined with water to remove nitrogen and sulfur impurities (e.g., water washed) and cooled in a second separator vessel (still under elevated pressure) to a relatively low temperature in the range from about 75° F. to about 150° F. prior to being compressed, optionally receiving fresh hydrogen, and being recycled. Furthermore, liquid effluent from the second (low temperature) separator can be passed to conventional low pressure separation vessels and/or the common fractionator. Although a major portion of the recycled hydrogen-containing vapor can be mixed with the hydrotreater and hydrocracker feeds at entry to the reactors, a controlled portion can be injected directly into the quench zones of the reactors to cool portions of the catalyst beds of the respective reactors.

DETAILED DESCRIPTION OF THE DRAWING

In the drawing, the process of the present invention is illustrated by means of a simplified flow diagram in which such details as the total number of reaction zone vessels, pumps, instrumentation, heat exchange and heat-recovery circuits, compressors and similar hardware have been deleted where non-essential to an understanding of the techniques involved. The use of such miscellaneous equipment is well within the purview of one skilled in the art.

Referring more particularly to FIG. 1, an atmospheric residuum feedstock or crude oil is supplied through line 10 to a vacuum tower 12 operating at a top pressure of about 2 p.s.i.a. The VGO overhead product exiting the vacuum tower through line 13 generally will boil in the range from about 650° F. to about 1,050° F. In one embodiment, the VGO is partitioned (split) into two streams and transferred through lines 15 and 17 into catalytic hydrocracking reactor 20 and catalytic hydrotreating reactor 22, respectively. Preferably, the VGO overhead product is fractionated into (1) a light VGO (LVGO) which is transferred from the vacuum tower to the hydrocracking reactor through line 14 and (2) a heavy VGO (HVGO) which is transferred from the vacuum tower to the hydrotreating reactor through line 16. A substantial amount of bottoms from the vacuum tower usually boiling above 1,050° F., and often above 1,100° F. is transferred by line 11 to suitable processing equipment, such as a coker.

In the hydrotreating reactor, the VGO (or HVGO) is hydrotreated under conditions necessary to reduce the organosulfur and organonitrogen concentrations to optimal levels for an FCC feedstock. In the parallel hydrocracking reactor the VGO (or LVGO) is hydrocracked under conditions necessary to produce a hydrocracked product containing a middle distillate stream. Both the hydrocracked product stream and the hydrotreated product stream may be cooled (not shown), hydrogen sulfide and ammonia partially or totally removed (not shown), and the product streams transferred via lines 24 and 26, respectively, to a liquid/vapor separator 28, which is a common separator for both hydroprocessed product streams.

The common separator is operated at an elevated temperature (typically above 300° F.) and pressure (typically above 400 p.s.i.g.). The pressure is preferably above 600 p.s.i.g., total pressure, and normally the same as the respective total pressures measured at the outlet of each reactor. The total pressures exiting both the hydrotreating and hydrocracking reactors are essentially the same. The product streams are separated into vapor effluent exiting via line 30 and liquid effluent exiting via line 32. The separated vapor effluent contains unreacted hydrogen gas and low boiling hydrocarbon compounds, while the separated liquid effluent contains the desired hydrocarbon products.

The vapor effluent is typically combined with water to remove ammonium bisulfide (not shown). The relatively hot (and pressurized) separated vapor in line 30 may be further separated into additional liquid and vapor in a cold-high pressure separator (not shown), usually at a temperature in the range from about 75° F. to 150° F. The separated vapor is compressed to a desired elevated hydrogen partial pressure in recycle gas compressor 34 and a portion of vapor recycled to hydrocracking reactor 20 via line 36 and a second portion concurrently recycled to hydrotreating reactor 22 via line 38.

For pressure control, additional fresh hydrogen is added to the system through line 40 via line 30 on the suction side of compressor 34 and directed to the reactors through lines 36 or 38. The fresh hydrogen may also be added via line 31, or the like, on the discharge side of compressor 34.

The liquid from the common separator is transferred via line 32 to fractionator 42 and is fractionated into several hydrocarbon products. For instance, the overhead products include a jet fuel having a smoke point above 25 (recovered from the fractionator via line 44), a diesel fuel having a cetane index from 45 to 80 (recovered from the fractionator through line 46), and naphthas and lighter products (recovered through line 43). An FCC feedstock having at least 90 volume percent of its components boiling above 700° F. can be recovered as the high boiling cut through a bottom line 48 having only about 12 to about 13 weight percent hydrogen. Due to its relatively low hydrogen content, the FCC feed is effectively processed in a FCC unit 70 without excessive overcracking of the gasoline produced therein. The hydrocracked product in line 24 generally contains about 13.5 to about 14.5 weight percent hydrogen, depending upon the relative flow rates to each reactor and the desired conversion in the hydrocracking reactor. In this processing scheme of the invention, the hydrotreated product in line 26 contains only about 12 to about 12.5 weight percent hydrogen, which combined in the common separator and fractionator system with a minor proportion of hydrocracked liquid effluent provides the relatively low 12–13 weight percent hydrogen content in the FCC feed.

Figure 2:
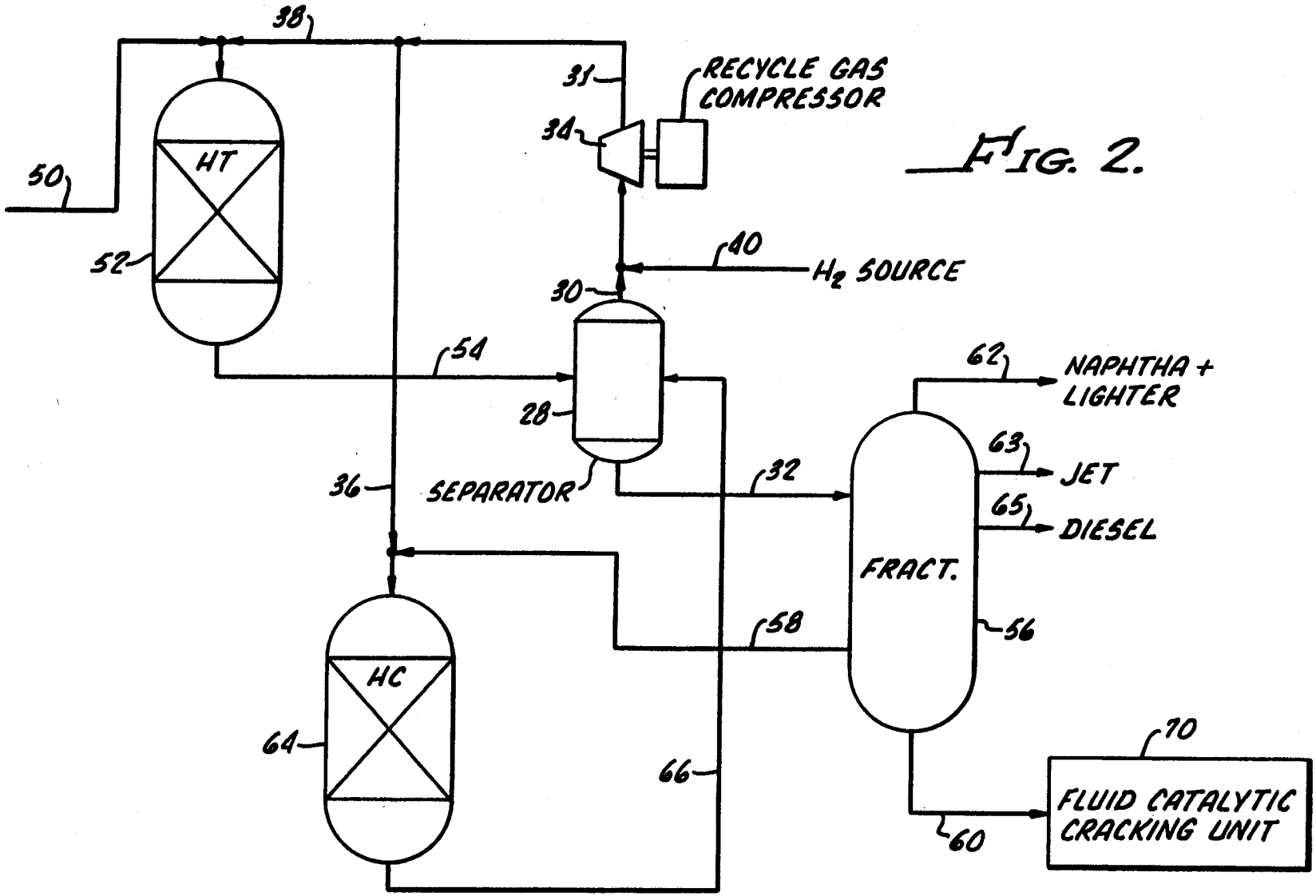

In another embodiment of the invention, depicted in FIG. 2, a feedstock such as an atmospheric residuum or VGO is initially supplied to a hydrotreating reactor 52 through line 50 to reduce the Conradson Carbon Residue (CCR), organometallic, organosulfur and organonitrogen compounds to desirable concentrations for an FCC feedstock (and saturate aromatic compounds). The pressure, temperature and space velocity are controlled to achieve the desired degree of hydrotreatment of a HVGO or upgraded residue fraction of the feedstock which will eventually be sent to an FCC operating unit 70.

The hydrotreated product is transferred from the hydrotreating reactor through line 54 to a common vapor/liquid separator 28 to be separated into (1) recycle hydrogen-containing vapor in line 30 (and compressed) and (2) a hydrocarbon liquid in line 32 in the same manner as in the processing scheme of FIG. 1. The hydrogen make up gas can also be introduced via line 40 at either the suction or discharge side of compressor 34 via lines 30 or 31, respectively.

The hydrocarbon liquid in line 32 from the hydrotreating reactor is supplied to a common fractionator 56 and fractionated into a HVGO fraction (typically boiling above 750° F.), a LVGO fraction (typically boiling below 950° F.) and middle distillate (and lighter) product streams (typically boiling below 700° F.) exiting the fractionator via middle line 58, bottom line 60 and overhead line(s) collectively 62, 63 and 65, respectively. The HVGO fraction in bottom line 60, in the case of processing an atmospheric residuum, will also contain a heavier boiling fraction, i.e., 1,050° F.+ (upgraded residue). The HVGO fraction containing minimal hydrogen is passed via line 60 to the FCC operating unit 70 and the middle distillate product streams such as naphtha jet fuel and diesel fuel in overhead lines 62, 63 and 65, are recovered by conventional means.

The LVGO fraction in middle line 58 is supplied to a catalytic hydrocracking reactor 64 and hydrocracked under conditions necessary to produce a hydrocracked product containing hydrocarbons, of which a significant portion boil in the middle distillate range or lower. The hydrocracked product exiting the hydrocracking reactor is transferred via line 66 to the common separator 28 with a significant proportion of the unconverted liquid components of the LVGO being recycled through the common fractionator 56 back through middle line 58 to the hydrocracking reactor. Under mildly controlled hydrocracking reactor conditions, a minor proportion of the unconverted liquid components of the LVGO may also be transferred from the fractionator through bottom line 60 to the FCC processing unit. A high quality middle distillate fraction derived from the hydrocracked product (including portions obtained from the hydrotreated product) is recovered from the common fractionator via overhead lines 63 and 65.

Hydrotreating catalysts employed in the present invention typically contain at least one hydrogenation metal component on a porous refractory oxide support and/or have at least some activity for hydrotreating hydrocarbon-containing feedstocks to convert sulfur and/or nitrogen components of the feedstock to hydrogen sulfide and/or ammonia, respectively. A preferred catalyst contains at least one Group VIB metal hydrogenation component and/or at least one Group VIII metal hydrogenation and optionally and preferably, at least one phosphorus component on the porous refractory support. In a highly preferred embodiment, the catalyst contains at least one cobalt or nickel hydrogenation component, at least one molybdenum hydrogenation component, and at least one phosphorus component supported on an amorphous, porous refractory oxide containing alumina, preferably gamma alumina.

Porous refractory oxide support material of the hydrotreating catalysts employed herein typically contains amorphous inorganic refractory oxides such as silica, magnesia, silica-magnesia, zirconia, silica-zirconia, titania, silica-titania, alumina, silica-alumina, etc., with supports containing a transition alumina, such as gamma, theta, delta and/or eta alumina being highly preferred. Such support material is utilized to prepare catalysts having physical characteristics including a total pore volume greater than about 0.2 cc/gram and a surface area usually greater than about 100 $m^2$/gram. Ordinarily the total pore volume of the catalyst is about 0.2 to about 1.0 cc/gram. and preferably about 0.25 to about 0.75 cc/gram. and the surface area is ordinarily in the range from about 125 to about 500 $m^2$/gram. and preferably about 150 to about 350 $m^2$/gram.

Furthermore, preferred hydrotreating catalysts have a relatively narrow pore size distribution wherein at least about 75 percent, preferably at least about 80 percent, and most preferably at least about 85 percent of the total pore volume is in pores of diameter from about 50 to about 120 angstroms. Another porosity feature of preferred catalysts employed herein is the narrow pore size distribution of pores of diameter slightly above or below the median pore diameter which typically lies in the range from about 65 to about 120 angstroms, preferably about 70 to about 110 angstroms. Ordinarily, at least about 50 percent of the total volume of the catalysts is contained in pores of diameter within 50 angstroms of the median pore diameter.

Examples of hydrogenation metals loadings and physical characteristics preferred catalysts for use herein are disclosed in U.S. Pat. No. 4,846,961 issued to Robinson et al., U.S. Pat. No. 4,818,743 issued to Simpson et al., and U.S. Pat. No. 4,686,030 issued to Ward, the disclosures of which are incorporated by reference herein in their entireties.

In the case of hydrocracking, the present invention utilizes a hydrocracking catalyst useful in the production of a high yield of 700° F.− hydrocarbon products. The hydrocracking catalyst contains at least one hydrogenation component combined with at least one cracking component.

The hydrogenation component, such as the oxides or sulfides thereof, typically comprises from about 0.5 to about 40 weight percent, preferably about 2 to about 20 weight percent, calculated as the metal, of the hydrocracking catalyst. The catalyst usually contains the metals, oxides and sulfides of the noble and non-noble Group VIII elements and the Group VIB elements. Suitable hydrogenation components are selected from the group consisting of the metals, oxides and sulfides of platinum, palladium, cobalt, nickel, tungsten and molybdenum. Non-noble Group VIII metals are usually employed in proportions between about 2 and 10 weight percent, calculated as the monoxide, and the Group VIB metals in a proportion between about 3 and 30 weight percent, calculated as the trioxide. When the hydrogenation component consists essentially of noble metal components, the hydrogenation component is usually present in proportion sufficient to ensure that the catalyst contains between about 0.05 and about 10 weight percent of the hydrogenation component, preferably between about 0.10 weight percent and about 3.0 weight percent, calculated as the metal.

The hydrocracking catalyst employed in the process of the invention comprises a cracking component having sufficient acidity to impart activity for cracking a hydrocarbon oil. The cracking component may be combined with a binder or matrix material comprising a porous, inorganic refractory oxide component having essentially no cracking activity. Suitable cracking components include amorphous silica-aluminas and crystalline molecular sieves having cracking activity. Examples of silica-alumina cracking components are disclosed in U.S. Pat. Nos. 4,097,365, 4,419,271 and 4,600,498 issued to Ward, the disclosures of which are incorporated by reference herein. Crystalline molecular sieves are preferred cracking components. The term "crystalline molecular sieve" as used herein refers to any crystalline cracking component capable of separating atoms or molecules based on their respective dimensions. Crystalline molecular sieves are typically zeolitic. Zeolitic molecular sieves contain frameworks formed of substantially only silica and alumina tetrahedra such as the framework present in ZSM-5 type zeolites, Y zeolites, and X zeolites. Examples of zeolitic crystalline molecular sieves which can be used as a cracking component of the catalyst include Y zeolite, fluorided Y zeolites, X zeolites, zeolite beta, zeolite L, mordenite and zeolite omega.

Preferred zeolitic crystalline molecular sieves are crystalline aluminosilicate Y zeolites. U.S. Pat. No. 3,130,007, the disclosure of which is hereby incorporated by reference in its entirety, describes Y-type zeolites having an overall silica-to-alumina mole ratio between about 3.0 and about 6.0, with a typical Y zeolite having an overall silica-to-alumina mole ratio of about 5.0. A preferred member of this group is known as Y-82, a zeolitic aluminosilicate molecular sieve available from the Linde Division of the Union Carbide Corporation. Another group of Y zeolites which may be used as a molecular sieve in the catalyst of the invention is comprised of zeolites normally having an overall silica-to-alumina mole ratio above about 6.0, preferably between about 6.1 and about 15.

Catalysts are activated in accordance with methods suited to hydroprocessing, particularly to a hydrocracking, hydrodenitrogenation and/or hydrodesulfurization process. Most of the catalysts used in the process of the invention are more active, sometimes even far more active, in a sulfided form than in the oxide form in which they are generally prepared (particularly the non-noble metal containing hydrocracking and hydrotreating catalysts). Accordingly, hydroprocessing catalysts used herein may be sulfided prior to use by any known method (in which case the procedure is termed "presulfiding"), for example, by passing a sulfiding agent in the presence of hydrogen over the catalyst prepared in the calcined form. Also, since the hydroprocess may be employed to upgrade sulfur-containing hydrocarbons (i.e., hydrodesulfurization), one may, as an alternative, accomplish the sulfiding in situ with sulfur-containing hydrocarbon oils, particularly those containing sufficient sulfur to maintain the catalyst in the sulfided form. In another alternative form, the catalyst may be sulfided ex situ by treatment with a sulfur-containing medium prior to loading into the reactor vessels.

The hydroprocessing catalysts may be employed as either a fixed, slurried or fluidized beds (but most usually fixed beds) of particulates in a suitable reactor vessel wherein a hydrocarbon-containing feedstock (usually liquid) is introduced and subjected to hydrocarbon conversion conditions including an elevated total pressure, temperature, and hydrogen partial pressure, so as to effect the desired degree of conversion in both the hydrotreating and hydrocracking reaction zones. The feedstock is usually passed downwardly once through the reactor vessel or maybe recycled therethrough. In some instances, one or more additional reactors, in series, may be added to either the single hydrocracking or hydrotreating reactor.

Both the hydrotreating and hydrocracking reactors are concurrently operated at the same hydroprocessing conditions. Typical hydroprocessing conversion operation conditions in each reaction zone include a temperature from about 50° C. to about 500° C., a pressure from about 50 p.s.i.g. to about 4,000 p.s.i.g., and a liquid hourly space velocity of about 0.05 to about 25 vol/vol-hr. The hydrocarbon-containing feedstock contacts the catalyst under hydroprocessing conditions including a hydrogen recycle rate usually about 1,000 to about 15,000, and preferably about 1,000 to about 8,000 standard cubic feet per barrel (scf/bbl). Under such hydroprocessing conditions, the hydrocarbon oil and catalyst are subjected to a hydrogen partial pressure usually in the range from about 100 to about 4,000 p.s.i.g. at a space velocity usually in the range from about 0.05 to about 20 LHSV so as to effect the desired degree of hydroprocessing.

Typical hydroprocessing conditions suitable for hydrotreating (i.e., hydrodenitrogenation or hydrodesulfurization) or hydrocracking (i.e., those processes that yield more than about 10 volume percent conversion of the oil fraction boiling above 700° F., to liquid products boiling at or below 700° F.), are shown in the following Table I:

TABLE I

| Operating Conditions Range | Suitable Range | Preferred |
|---|---|---|
| Temperature, °F. | 500–900 | 600–850 |
| Hydrogen Pressure, p.s.i.g. | 200–4,000 | 400–2,500 |
| Space Velocity, LHSV | 0.05–10 | 0.1–5.0 |
| Hydrogen Recycle Rate, scf/bbl | 500–15,000 | 1,000–10,000 |

Generally, the hydrogen partial pressure maintained during hydroprocessing is more than 50 percent and preferably more than 70 percent of the total pressure. It is highly preferred that the hydrogen partial pressure is greater than 85 percent of the total pressure.

In the process of the invention, the hydrocracking conditions are adjusted so as to obtain a substantial degree of cracking per pass of hydrocarbon feed over the catalyst. Usually, the cracking per pass is such as to convert a significant portion, ordinarily at least 30% by volume, preferably at least 60% to 80% by volume of the hydrocarbon-containing components above about 700° F. to hydrocarbon products boiling below about 700° F. Under preferred hydrocracking conditions, and with a typical gas oil, the product distribution is such that, of the products boiling in the range of $C_4$ hydrocarbons to about 700° F., the gasoline product boiling between 50° F. and the end point of a typical light or heavy gasoline fraction (i.e., about 420° F.) comprises a minor proportion, while the middle distillate product boiling between about 250° F. (and preferably 300° F.) and the end point of a typical heavy diesel fraction (i.e., about 700° F. or in some cases as high as 750° F.) comprises a substantial proportion. The proportion of the middle distillate product in the distribution of the 700°

F.— product is ordinarily above 50%, preferably above 70%, and most preferably above 80% by volume.

The exact conditions, of course, required to produce a desired result in any given hydrocracking process will depend primarily on the feedstock and the desired product, with the boiling point characteristics of the feedstock and desired product being particularly important factors in determining the conditions of operations. However, it is highly preferred that the hydrocracking reactor operate at a hydrogen partial pressure greater than about 1,200 p.s.i.g., preferably above 1,500 p.s.i.g., and most preferably above 1,800 p.s.i.g., as measured at the outlet of the hydrocracking reactor.

Although it is contemplated that the hydrocracking process of the invention may be carried out on a once-through basis, with collection of unconverted feed components, it is more desirable and preferable to operate with recycle of unconverted feed components boiling above the maximum desired product end point. Operation with recycle under ideal conditions converts the feedstock to extinction (i.e., a 100% conversion to products boiling below the maximum desired temperature of the product). Usually, however, one must operate with a bleed of unconverted feed components, resulting in a conversion over 90% but not quite to extinction.

One of the advantages of the process of the invention is that it allows a petroleum refiner a certain degree of flexibility when operating under hydrocracking conditions. Where some hydrocracking processes are primarily designed for the maximum production of middle distillate products (or lighter) under relatively severe conditions, the present processing scheme under relatively moderate conditions (relative to the feedstock involved) reduces total hydrogen consumption most advantageously to produce a relatively high yield of a middle distillate fraction having high quality and still produce an FCC feed having sulfur content below 0.3 weight percent (as S) and a hydrogen content less than 13.5 weight percent. And if the occasion demands, the operating conditions may be adjusted for maximizing the middle distillate production, depending on the feedstock involved. Thus, the invention provides for a "flexible" hydrotreating/hydrocracking process which is of most advantageous use in those situations where a relatively high yield of middle distillate products having improved quality is primarily desired, but where it will occasionally be necessary to shift to maximum low-sulfur/low-nitrogen FCC feed production for required periods of time.

While particular embodiments of the invention have been described, it will be understood, of course, that the invention is not limited thereto since many obvious modifications can be made, and it is intended to include within this invention any such modifications as will fall within the scope of the invention as defined by the appended claims.

What is claimed is:

1. A parallel hydrotreating and hydrocracking process comprising:

hydrotreating a relatively high boiling hydrocarbon-containing feedstock comprising heavy residual fractions or gas oils comprising mostly components boiling above 700° F., separately hydrocracking a hydrocarbon-containing feedstock;

introducing into the same separating vessel (1) an effluent exiting a catalytic hydrotreating reaction zone of said hydrotreating and (2) a separate effluent stream exiting a parallel catalytic hydrocracking zone of said hydrocracking;

concurrently separating said effluent and said effluent stream in said separating vessel into a vapor comprising hydrogen and a hydrocarbon-containing liquid at a hydrogen partial pressure above 400 p.s.i.g.; and fractionating said hydrocarbon-containing liquid to recover (1) a first hydrocarbon product having at least 90 volume percent of its components boiling above 700° F., and (2) a second hydrocarbon product comprising middle distillates and lighter product fractions add having essentially all its components boiling at or below 700° F.

2. The process defined in claim 1 wherein said second hydrocarbon product is a middle distillate fraction comprising a diesel fuel having a cetane index greater than 40.

3. The process defined in claim 1 wherein said second hydrocarbon product is a middle distillate fraction comprising a jet fuel or kerosine having a smoke point above 20 mm.

4. The process defined in claim 1 wherein at least a portion of said vapor is recycled to said catalytic hydrotreating zone at a hydrogen partial pressure above 400 p.s.i.g.

5. The process defined in claim 1 wherein at least a portion of said vapor is recycled to said catalytic hydrocracking zone at a hydrogen partial pressure above 400 p.s.i.g.

6. The process defined in claim 1 wherein the entire effluent from said catalytic hydrotreating zone and the entire separate effluent stream from said catalytic hydrocracking zone pass into said separating vessel.

7. The process defined in claim 1 wherein said hydrocarbon-containing feedstock passing into said catalytic hydrotreating zone comprises a first portion of a gas oil and said hydrocarbon-containing feedstock passing into said catalytic hydrocracking zone comprises a second portion of said gas oil.

8. The process defined in claim 1 wherein said hydrocarbon-containing feedstock is selected from the group consisting of vacuum gas oil, coker gas oil, visbreaker gas oil and cracked gas oil.

9. The process defined in claim 1 wherein a lower weight percentage of hydrogen, calculated as H, is contained in said first hydrocarbon product comprising a fluid catalytic cracking feedstock than contained in a liquid portion of said effluent stream exiting said catalytic hydrocracking zone.

10. The process defined in claim 1 wherein a hydrocarbon-containing feedstock passing into said catalytic hydrotreating zone comprises a heavy vacuum gas oil having at least 90 volume percent of its components boiling above 700° F. and a second hydrocarbon-containing feedstock passing into said catalytic hydrocracking zone comprises a light vacuum gas oil having at least 90 volume percent of its components boiling below 900° F.

11. The process defined in claim 1 wherein said separating occurs at a temperature above 300° F.

12. The process defined in claim 2 wherein said first hydrocarbon product comprises a fluid catalytic cracking feedstock containing less than 0.3 weight percent of organosulfur compounds, calculated as S.

13. The process defined in claim 3 wherein said first hydrocarbon product comprises a fluid catalytic cracking feedstock containing less than 13.5 weight percent of hydrogen, calculated as H.

14. An integral hydroprocess comprising hydrotreating and hydrocracking, said hydroprocess comprising:

fractionating a hydrocarbon-containing feedstock having at least 95 volume percent of its components boiling in the range from about 650° F. to about 1,050° F. to recover (a) a relatively high boiling first hydrocarbon-containing fraction having at least 90 volume percent of its components boiling above about 750° F., and (b) a relatively low boiling second hydrocarbon-containing fraction having at least 90 volume percent of its components boiling below about 950° F.;

passing said relatively high boiling first hydrocarbon-containing fraction through a catalytic hydrotreating reaction zone under hydrotreating conditions to lower the concentration of sulfur or nitrogen in said first hydrocarbon-containing fraction and to produce a hydrotreated product comprising (1) a first hydrocarbon product comprising middle distillates and lighter product fractions and having essentially all its components boiling below 750° F., and (2) a second hydrocarbon product having at least 90 volume percent of its components boiling above 750° F.;

passing said relatively low boiling second hydrocarbon-containing fraction through a catalytic hydrocracking reaction zone under hydrocracking conditions to produce a hydrocracked product comprising (1) a third hydrocarbon product Comprising middle distillates and lighter product fractions and having essentially all its components boiling below 750° F., and (2) a fourth hydrocarbon product having at least 90 volume percent of its components boiling above 750° F.;

introducing said hydrotreated product and said hydrocracked product into a common separating vessel and separating said hydrotreated product and said hydrocracked product into a vapor and a hydrocarbon-containing liquid; and fractionating said hydrocarbon-containing liquid to recover a common feedstock comprising said second hydrocarbon product and said fourth hydrocarbon product and having at least 90 volume percent of said common feedstock components boiling above 750° F.

15. The hydroprocess defined in claim 14 wherein said hydrotreated product from said catalytic hydrotreating reaction zone and said hydrocracked product from said catalytic hydrocracking reaction zone are under essentially the same elevated hydrogen partial pressure above 400 p.s.i.g., as measured for a recycle gas separated from liquid portions of said first, second, third and fourth hydrocarbon products.

16. The hydroprocess defined in claim 14 wherein said hydrocarbon-containing feedstock comprises a vacuum gas oil, coker gas oil or visbreaker gas oil.

17. The hydroprocess defined in claim 14 wherein said first hydrocarbon-containing fraction contains at least 75 volume percent of its components boiling above about 850° F.

18. The hydroprocess defined in claim 14 wherein said second hydrocarbon-containing fraction contains at least 75 volume percent of its components boiling below about 850° F.

19. The hydroprocess defined in claim 14 wherein said first hydrocarbon product and said third hydrocarbon product each comprise a hydrocarbon boiling fraction selected from the group consisting of a diesel fuel, jet fuel, naphtha, kerosine, gasoline and a turbine fuel.

20. The hydroprocess defined in claim 14 wherein said common feedstock and said second hydrocarbon product each contain a lower weight percentage of hydrogen, calculated as H, than said fourth hydrocarbon product.

21. The hydroprocess defined in claim 19 wherein a combination of said first hydrocarbon product and said third hydrocarbon product comprises a jet fuel or kerosine having a smoke point greater than 20 mm or a diesel fuel having a cetane index greater than 40.

22. The hydroprocess defined in claim 15 wherein said hydrotreated product and said hydrocracked product are concurrently introduced into said common separator vessel and concurrently separated into said hydrocarbon-containing liquid and said vapor at an elevated hydrogen partial pressure above about 600 p.s.i.g., said hydrocarbon-containing liquid is fractionated into (1) said common feedstock, and (2) a combined hydrocarbon product comprising said first hydrocarbon product and said third hydrocarbon product and having essentially all its components boiling below 750° F., and said vapor is concurrently passed under said elevated hydrogen partial pressure to said hydrotreating zone and to said hydrocracking zone.

23. The hydroprocess defined in claim 14 whereby less elemental hydrogen is consumed than consumed in a comparative hydroprocess passing said hydrocarbon-containing feedstock through a catalytic hydrocracking reaction zone producing the same volume of said common feedstock but without said fractionating of said hydrocarbon-containing feedstock.

24. The hydroprocess defined in claim 22 wherein said combined hydrocarbon product comprises a diesel fraction having a higher cetane index number than that of a diesel fraction produced by a comparative hydroprocess passing said hydrocarbon-containing feedstock through a catalytic hydrocracking reaction zone producing the same volume of said common feedstock but without said fractionating into said first and said second hydrocarbon-containing fractions.

25. The hydroprocess defined in claim 14 wherein said hydrotreated product and said hydrocracked product are separated into liquid and vapor components in the same separating vessel under an elevated pressure above about 400 p.s.i.g.

26. The hydroprocess defined in claim 21 wherein said common feedstock contains less than 0.3 weight percent of organosulfur, calculated as S.

27. The hydroprocess defined in claim 21 wherein said common feedstock contains less than 13.5 weight percent of hydrogen, calculated as H.

28. A hydroprocess process comprising hydrotreating and hydrocracking, said hydroprocess comprising:

passing a hydrocarbon-containing feedstock comprising heavy residual fractions or gas oils comprising mostly components boiling above 700° F. through a catalytic hydrotreating zone under hydrotreating conditions to lower the concentration of organosulfur or organonitrogen in said hydrocarbon-containing feedstock and to produce a hydrotreated product containing (1) a relatively low boiling first hydrocarbon product comprising middle distillates and lighter product fractions and having essentially all its components boiling below 750° F., and (2) a relatively high boiling second hydrocarbon product having at least 90 volume percent of its components boiling above about 600° F.;

introducing said hydrotreated product into a separating vessel and separating said hydrotreated product into a vapor comprising hydrogen and a hydrocarbon-containing liquid comprising said relatively low boiling first hydrocarbon product and said relatively high boiling second hydrocarbon product;

fractionating said relatively high boiling second hydrocarbon product contained in said hydrocarbon-containing liquid to recover (a) a relatively high boiling first hydrocarbon-containing fraction having at least 90 volume percent of its components boiling above 750° F., or an upgraded residue comprising hydrocarbon components boiling at or above 1050° F., and (b) a relatively low boiling second hydrocarbon-containing fraction having at least 90 volume percent of its components boiling below about 950° F.;

passing said relatively low boiling second hydrocarbon-containing fraction through a catalytic hydrocracking reaction zone under hydrocracking conditions to produce a hydrocracked product comprising a third hydrocarbon product comprising middle distillates and lighter product fractions and having essentially all its components boiling below 750° F.;

introducing said hydrocracked product into said separating vessel;

concurrently separating a fluid comprising said hydrotreated product and said hydrocracked product in said separating vessel into a vapor comprising hydrogen and said hydrocarbon-containing liquid comprising said first hydrocarbon product, said second hydrocarbon product and said third hydrocarbon product.

29. The hydroprocess defined in claim 28 wherein said hydrocracked product further comprises a fourth hydrocarbon product having at least 90 volume percent of its components boiling above 750° F.

30. The hydroprocess defined in claim 29 wherein said fourth hydrocarbon product is combined with said second hydrocarbon-containing fraction and recycled through said hydrocracking reaction zone.

31. The hydroprocess defined in claim 28 wherein said hydrocarbon-containing feedstock is selected from the group consisting of atmospheric residuum, vacuum gas oil, coker gas oil and visbreaker gas oil.

32. The hydroprocess defined in claim 28 wherein said first hydrocarbon-containing fraction contains at least 75 volume percent of its components boiling above about 850° F.

33. The hydroprocess defined in claim 28 wherein said second hydrocarbon-containing fraction contains at least 75 volume percent of its components boiling below about 850° F.

34. The hydroprocess defined in claim 28 wherein said first hydrocarbon product and said third hydrocarbon product each comprise a hydrocarbon boiling fraction selected from the group consisting of a diesel fuel, jet fuel, naphtha, kerosine, gasoline and a turbine fuel.

35. The hydroprocess defined in claim 28 wherein said first hydrocarbon product and said second hydrocarbon product each contain a smaller weight percentage of hydrogen, calculated as H, than said third hydrocarbon product.

36. The hydroprocess defined in claim 34 wherein a combined hydrocarbon product comprising said first hydrocarbon product and said third hydrocarbon product is fractionated from said second hydrocarbon product to produce a jet fuel or kerosine having a smoke point greater than 20 mm or a diesel fuel having a cetane index number greater than 40.

37. The hydroprocess defined in claim 28 wherein said hydrotreated product and said hydrocracked product are separated into said liquid and said vapor at an elevated hydrogen partial pressure above about 400 p.s.i.g., said liquid is fractionated into said second hydrocarbon product and a combined hydrocarbon product comprising said first hydrocarbon product and said third hydrocarbon product and having essentially all its components boiling below 750° F.

38. The hydroprocess defined in claim 28 whereby less elemental hydrogen is consumed than consumed in a comparative hydroprocess passing said hydrocarbon-containing feedstock through a catalytic hydrocracking reaction zone producing the same volume of said second hydrocarbon product but without said fractionating of said hydrocarbon-containing feedstock.

39. The hydroprocess defined in claim 36 wherein said combined hydrocarbon product comprises a diesel fraction having a higher cetane index number than that of a diesel fraction produced by a comparative hydroprocess passing said hydrocarbon-containing feedstock through a catalytic hydrocracking reaction zone producing the same volume of said second hydrocarbon product but without said fractionating into said first and said second hydrocarbon-containing fractions.

40. The hydroprocess defined in claim 29 wherein said first hydrocarbon-containing fraction is combined with said fourth hydrocarbon product prior to passing through said fluid catalytic cracking reaction zone and the combined feedstream contains less than 0.3 weight percent of organosulfur, calculated as S.

41. The hydroprocess defined in claim 29 wherein said first hydrocarbon-containing fraction is combined with said fourth hydrocarbon product prior to passing through said fluid catalytic cracking reaction zone and the combined feedstream contains less than 13.0 weight percent of hydrogen, calculated as H.

42. A hydroprocess comprising hydrotreating and hydrocracking, said hydroprocess comprising:

fractionating a vacuum gas oil having at least 95 volume percent of its components boiling in the range from about 650° F. to about 1,050° F. to recover (a) a relatively high boiling first hydrocarbon-containing fraction having at least 90 volume percent of its components boiling above about 750° F., and (b) a relatively low boiling second hydrocarbon-containing fraction having at least 90 volume percent of its components boiling below about 950° F.;

passing said relatively high boiling first hydrocarbon-containing fraction through a catalytic hydrotreating reaction zone containing a catalyst comprising at least one hydrogenation metal on a porous, amorphous refractory oxide under hydrotreating conditions including an elevated temperature in the range from 500° F. to 900° F., a liquid hourly space velocity from 0.2 to 20, and a hydrogen partial pressure from 400 p.s.i.g. to 3,500 p.s.i.g., to lower the concentration of sulfur or nitrogen in said first hydrocarbon-containing fraction and to produce a hydrotreated feedstock containing (1) a first hydrocarbon product comprising middle distillates and lighter product fractions and having essentially all its components boiling below 750° F., and (2) a second hydrocarbon product having at least 90 volume percent of its components boiling from about 650° F. to about 1050° F.;

passing said relatively low boiling second hydrocarbon-containing fraction through a catalytic hydrocracking reaction zone containing a catalyst comprising a molecular sieve under hydrocracking conditions including an elevated temperature higher than that of said hydrotreating conditions and a hydrogen partial pressure above about 400 p.s.i.g. to produce a hydrocracked feedstock comprising (1) a third hydrocarbon product Comprising middle distillates and lighter product fractions and having essentially all its components boiling below 750° F., and (2) a fourth hydrocarbon product having at least 90 volume percent of its components boiling above 750° F.;

introducing said hydrotreated feedstock and said hydrocracking feedstock into the same separating vessel and concurrently separating, at an elevated hydrogen partial pressure above 400 p.s.i.g., a liquid containing said first, second, third and fourth hydrocarbon products from a vapor containing hydrogen;

fractionating said liquid to recover (1) a common feedstock comprising said second hydrocarbon product and said fourth hydrocarbon product, and (2) a combined hydrocarbon product comprising said first hydrocarbon product and said third hydrocarbon product;

concurrently recycling said vapor to said catalytic hydrotreating zone and to said catalytic hydrocracking zone at an elevated hydrogen partial pressure above 400 p.s.i.g.; and passing said common feedstock through a fluid catalytic cracking reaction zone to produce a product comprising gasoline.

43. The hydroprocess defined in claim 42 wherein said combined hydrocarbon product comprises a jet fuel or kerosine having a smoke point greater than 20 mm or a diesel fuel having a cetane index greater than 40.

44. The hydroprocess defined in claim 42 wherein said first hydrocarbon-containing fraction comprises a heavy vacuum gas oil fraction and said second hydrocarbon-containing fraction comprises a light vacuum gas oil fraction.

45. The hydroprocess defined in claim 42 wherein of said hydrotreated feedstock and said hydrocracked feedstock are concurrently separated into said liquid and said vapor at a temperature above 300° F., and additional portions of said liquid are separated downstream at a temperature in the range from about 75° F. to about 150° F.

46. The hydroprocess defined in claim 43 wherein said common feedstock comprises less than 13 weight percent of elemental hydrogen, and less than 0.3 weight percent of organosulfur compounds, calculated as S.

47. A hydroprocess comprising:

partitioning a hydrocarbon-containing feedstock having at least 90 volume percent of its components boiling in the range from about 650° F. to about 1,050° F., and passing a first portion of said feedstock into a catalytic hydrocracking reaction zone and a second portion of said feedstock into a parallel catalytic hydrotreating zone;

concurrently introducing into the same separating vessel a fluid comprising (1) an effluent exiting said catalytic hydrotreating reaction zone and (2) a separate effluent stream exiting said catalytic hydrocracking zone;

separating said fluid in said separating vessel into a vapor comprising hydrogen and a hydrocarbon-containing liquid at a hydrogen partial pressure above 400 p.s.i.g.; and fractionating said hydrocarbon-containing liquid to recover (1) a fluid catalytic cracking feedstock and (2) a middle distillate fraction.

48. The hydroprocess defined in claim 47 wherein said middle distillate fraction comprises a diesel fuel having a cetane index above 40.

49. The hydroprocess defined in claim 47 wherein said fluid catalytic cracking feedstock contains less than 13.5 weight percent of hydrogen, calculated as H.

* * * * *